US011583041B2

(12) United States Patent
Tapia

(10) Patent No.: US 11,583,041 B2
(45) Date of Patent: Feb. 21, 2023

(54) SLIP CLASP

(71) Applicant: David Tapia, Fredericksburg, TX (US)

(72) Inventor: David Tapia, Fredericksburg, TX (US)

( * ) Notice: Subject to any disclaimer, the term of this patent is extended or adjusted under 35 U.S.C. 154(b) by 0 days.

(21) Appl. No.: 17/717,767

(22) Filed: Apr. 11, 2022

(65) Prior Publication Data

US 2022/0400817 A1 Dec. 22, 2022

Related U.S. Application Data

(60) Provisional application No. 63/211,346, filed on Jun. 16, 2021.

(51) Int. Cl.
*A44C 5/20* (2006.01)
*A44C 11/02* (2006.01)
*A44B 13/00* (2006.01)

(52) U.S. Cl.
CPC ..... *A44B 13/0076* (2013.01)

(58) Field of Classification Search
CPC ..... A44C 5/20; A44C 5/2019; A44C 5/2023; A44C 5/2057; A44B 13/0076
See application file for complete search history.

(56) References Cited

U.S. PATENT DOCUMENTS 1,494,610 A * 5/1924 McGlashan ..... A44B 11/28 24/701
3,936,914 A * 2/1976 Mancini ..... A44C 5/2057 24/698.2
4,502,192 A * 3/1985 Hess ..... A44C 5/2057 24/593.1
4,524,495 A * 6/1985 Hess ..... A44C 5/2057 24/593.1
4,539,736 A * 9/1985 Yokosuka ..... E05G 7/00 24/574.1
4,713,864 A * 12/1987 Hess ..... A44C 5/2057 24/654
4,998,330 A * 3/1991 D'Amore, Jr. ..... A44C 5/2057 24/700
5,774,957 A * 7/1998 Kohl ..... A44C 5/2057 24/616
D418,449 S * 1/2000 Lawrence, Jr. ..... D11/212
6,058,576 A * 5/2000 Harris ..... A44C 5/2057 24/616
6,804,868 B2 * 10/2004 Fox ..... A44C 5/2057 24/598.5

* cited by examiner

*Primary Examiner* — Jack W Lavinder

(74) *Attorney, Agent, or Firm* — McKinnie & Paul. PLLC

(57) ABSTRACT

The present invention utilizes a female coupler and male coupler to connect jewelry. The male coupler, featuring a stop, a shaft, and a buffer slides into a first channel within the shoot portion of a female coupler. The stop is rotated into position within a second channel of the scoop portion of the female coupler. The scoop portion secures the male coupler within the female coupler until a user forcibly rotates the stop to remove it from the scoop portion. The present invention only requires grasping of each of coupler and does not require squeezing any components.

16 Claims, 10 Drawing Sheets

SLIP CLASP

CROSS-REFERENCES TO RELATED APPLICATIONS

This application claims the benefit of U.S. Provisional Application Ser. No. 63/211,346, filed Jun. 16, 2021, entitled Slip Clasp, which is incorporated by reference herein.

STATEMENT REGARDING FEDERALLY SPONSORED RESEARCH OR DEVELOPMENT

Not applicable.

BACKGROUND OF THE INVENTION

1. Field of the Invention

The present invention relates to clasp used to secure jewelry such as necklaces and bracelets.

2. Background of the Related Art

Clasps are used to secure rope or chain like jewelry around a person's neck, wrist, or ankle. Clasps, especially the common spring, lobster, and toggle clasps, are difficult to operate and require excellent dexterity. Elderly, young, and those with hand ailments often do not possess the dexterity or strength to operate clasps which results individuals unable to wear certain jewelry without the assistance of a second person.

SUMMARY OF THE INVENTION

The present invention is an improved method to secure a necklace or bracelet without the use of spring, magnet, or other mechanical apparatus. The present invention utilizes a female coupler on one end of the chain and a male coupler on the other end of the chain. The female coupler includes a shoot portion, a ridge portion, and a scoop portion. A first channel is positioned within the shoot portion and a second, narrow channel, is within the ridge portion and scoop portion. The male coupler comprises a stop, a shaft, and a buffer. The stop is generally perpendicular to the shaft and the shaft is a narrow "S" shape.

To connect the male coupler to the female coupler, the stop slides into the first channel within the shoot portion of a female coupler. The buffer prevents the male coupler from extending too far through the first channel. The stop is then slid within the second channel and rotated into position within scoop portion of the female coupler. The scoop portion secures the male coupler within the female coupler until a user forcibly rotates the stop to remove it from the scoop portion. The present invention only requires grasping of each of coupler and does not require squeezing any components. The invention may be coupled by a right hand dominant or left-hand dominant person.

DETAILED DESCRIPTION OF THE INVENTION

Figure 1:
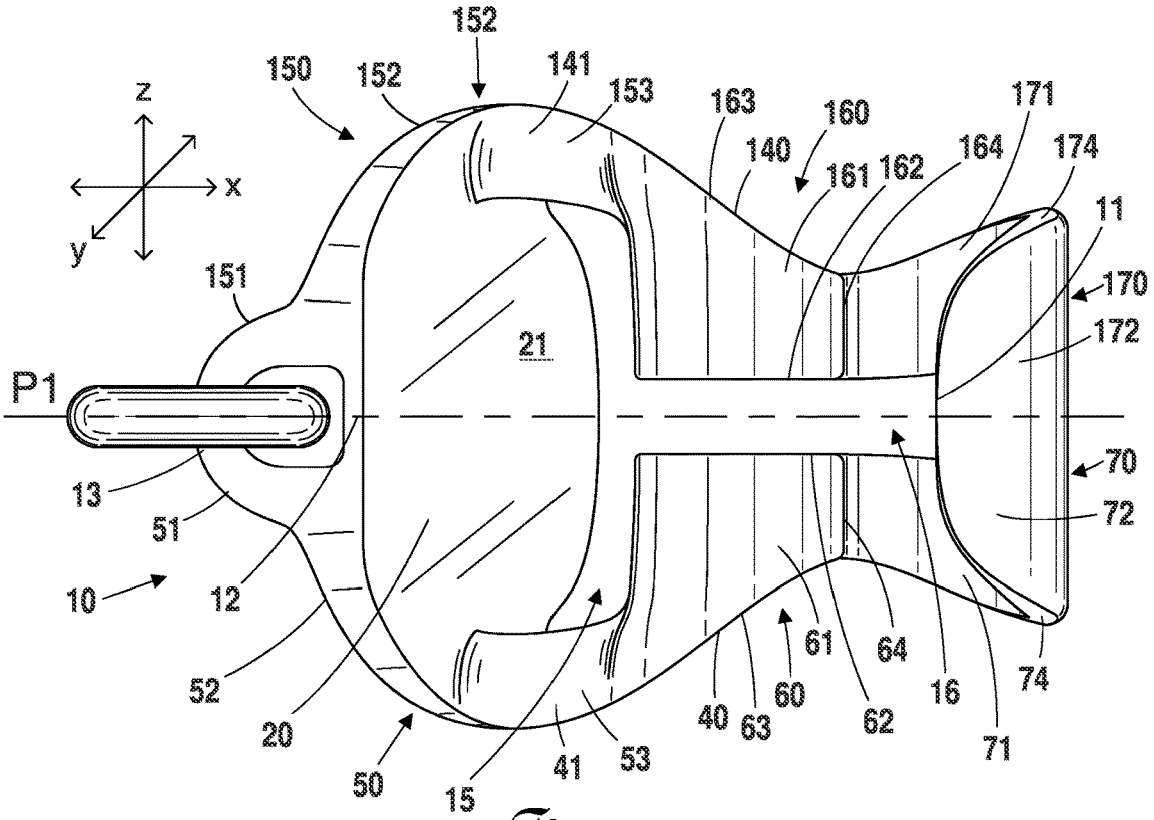
FIG. 1 is a top-down view of an embodiment of the cradle portion of the present invention.
Figure 2:
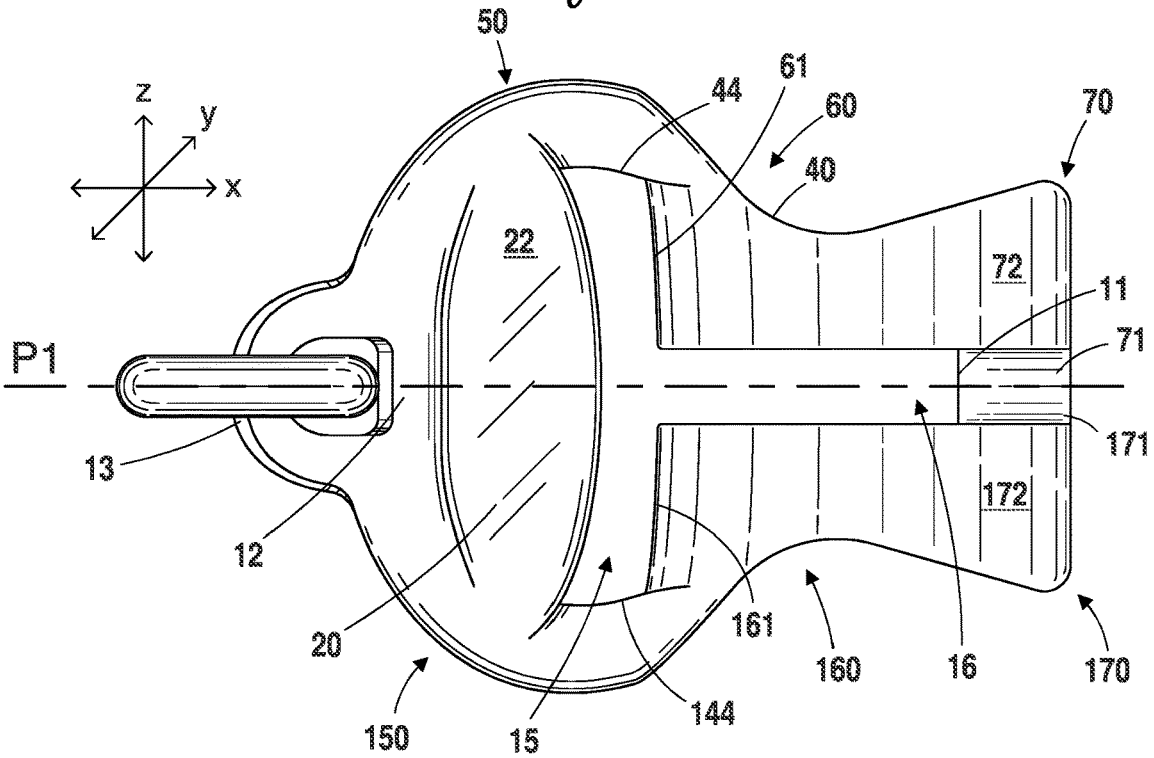
FIG. 2 is a bottom up down view of an embodiment of the cradle portion of the present invention.
Figure 3:
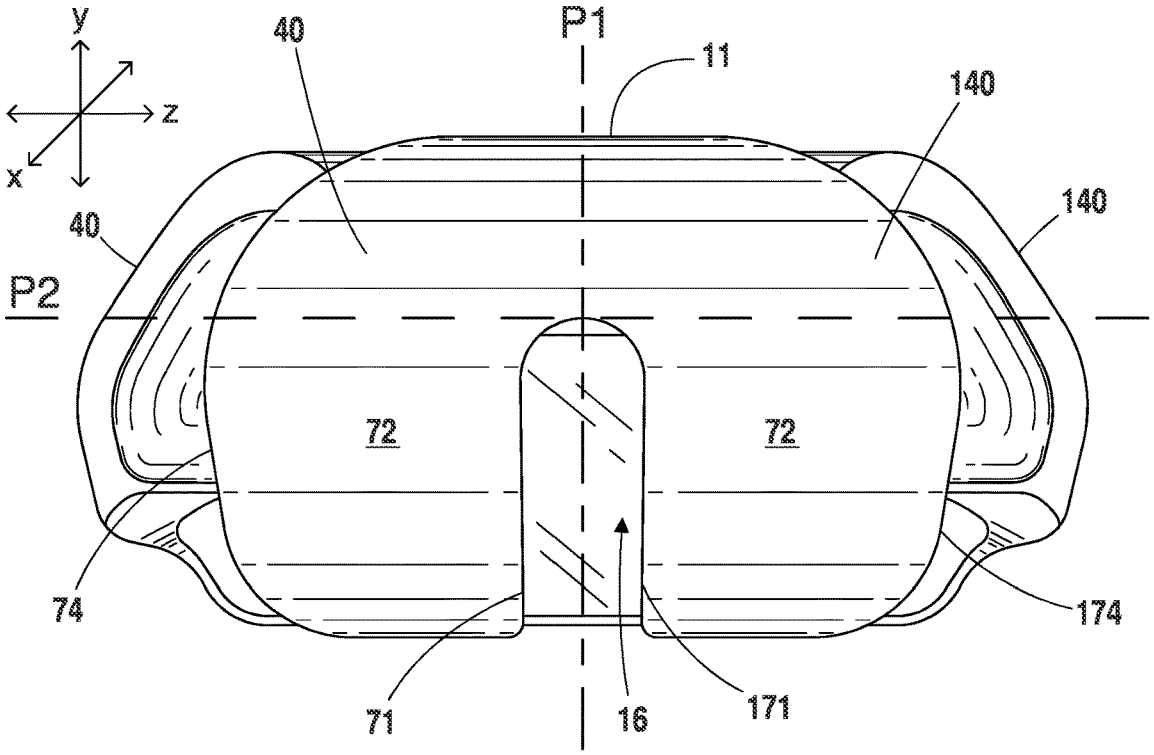
FIG. 3 is a front view of an embodiment of the cradle portion of the present invention.
Figure 4:
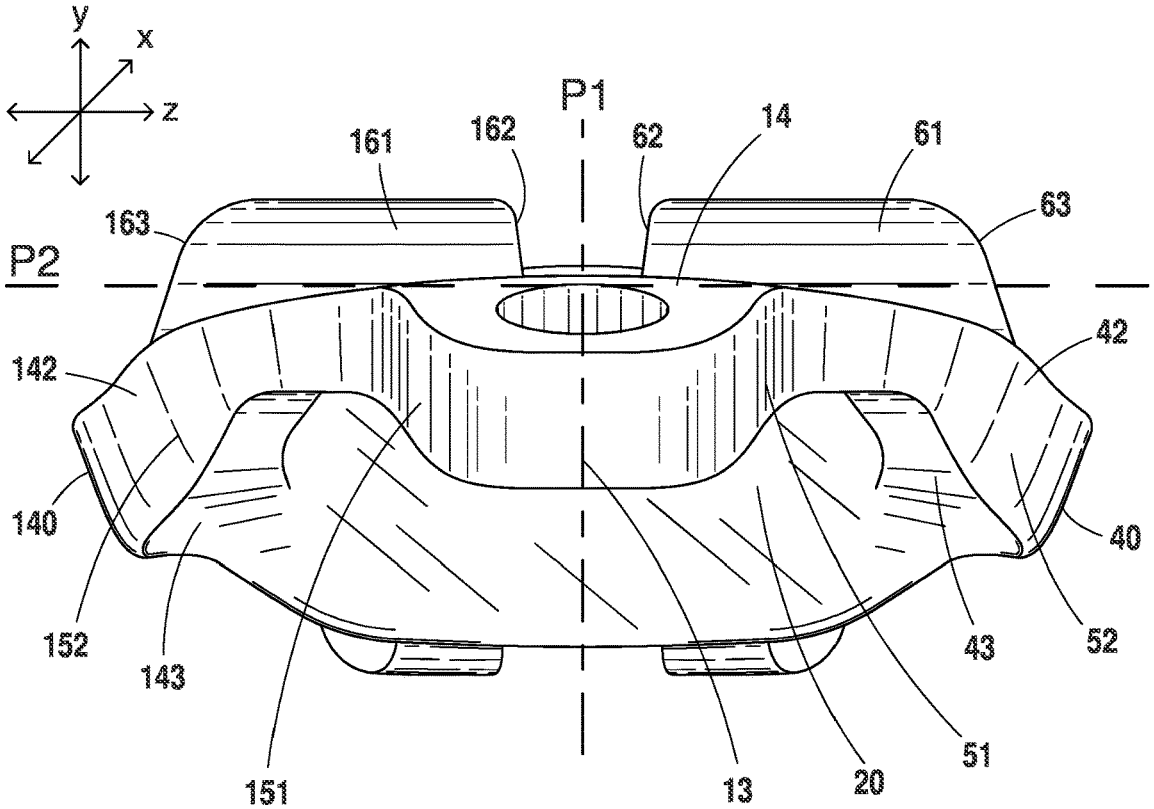
FIG. 4 is a rear view of an embodiment of the cradle portion of the present invention.
Figure 5:
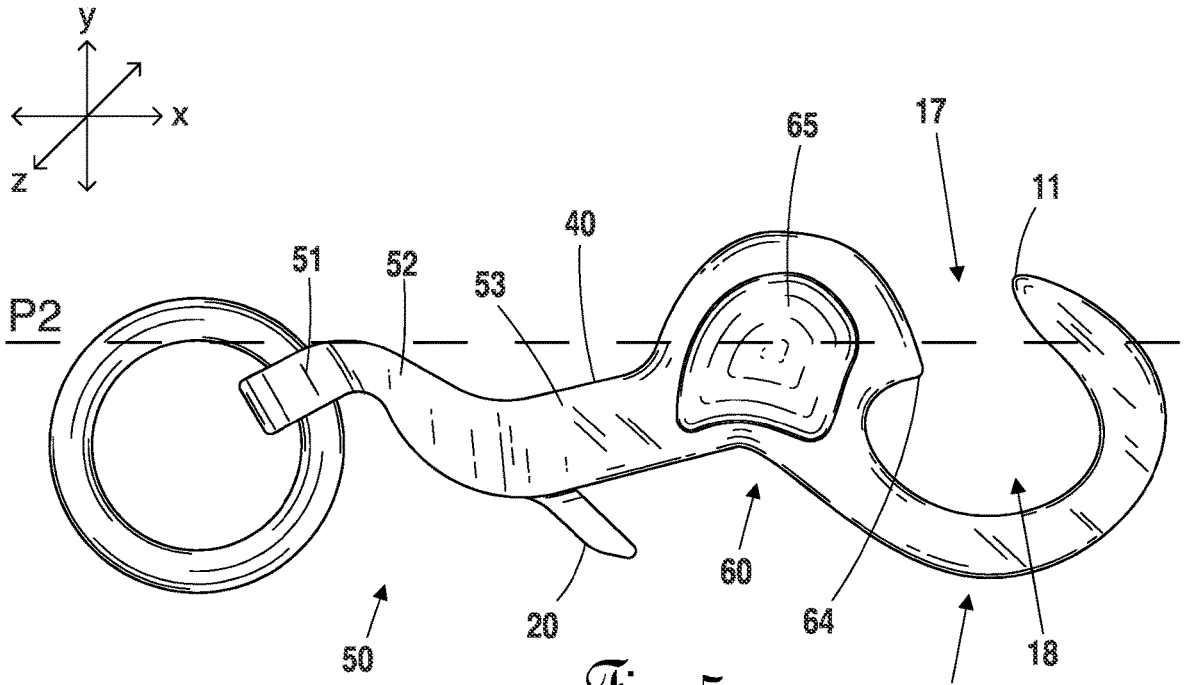
FIG. 5 is a side view of an embodiment of the cradle portion of the present invention.
Figure 6:
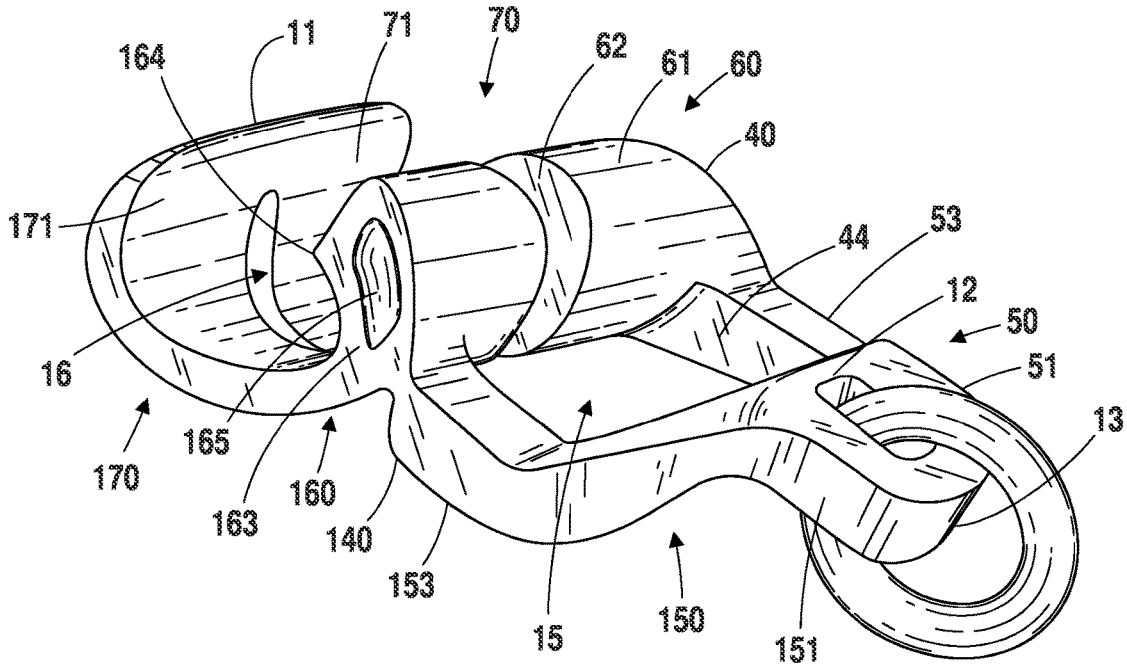
FIG. 6 is a perspective view of an embodiment of the cradle portion of the present invention.
Figure 7:
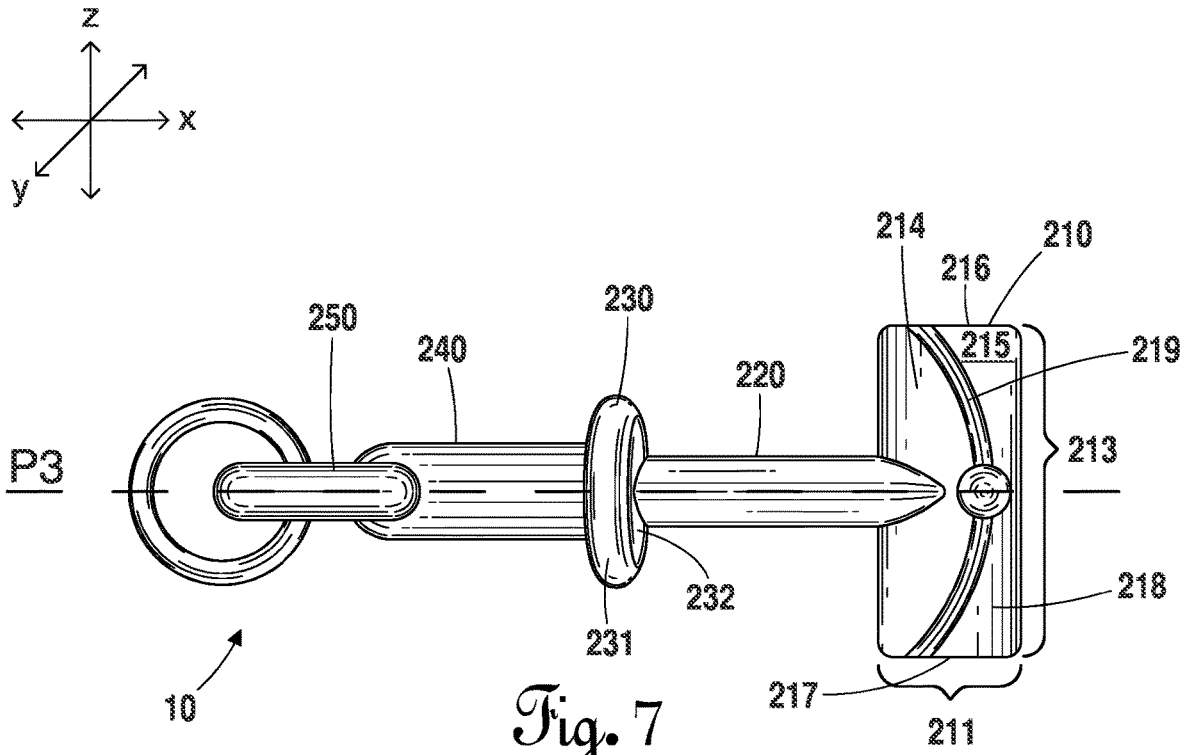
FIG. 7 is a top-down view of an embodiment of the transverse coupler portion of the present invention.
Figure 8:
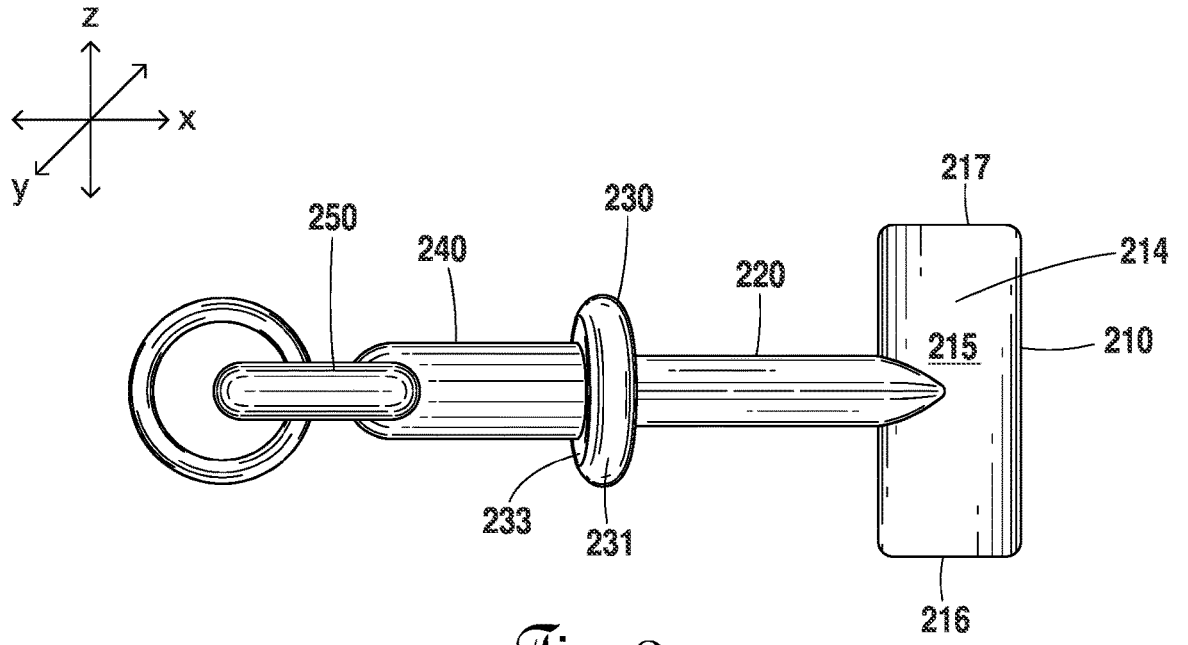
FIG. 8 is a bottom up down view of an embodiment of the transverse coupler portion of the present invention.
Figure 9:
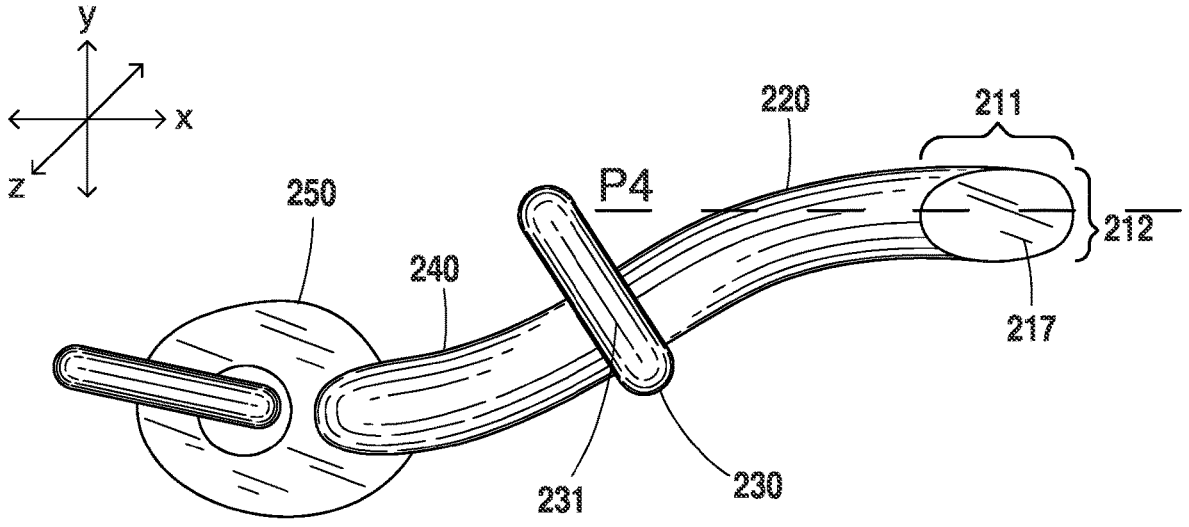
FIG. 9 is a side view of an embodiment of the transverse coupler portion of the present invention.
Figure 10:
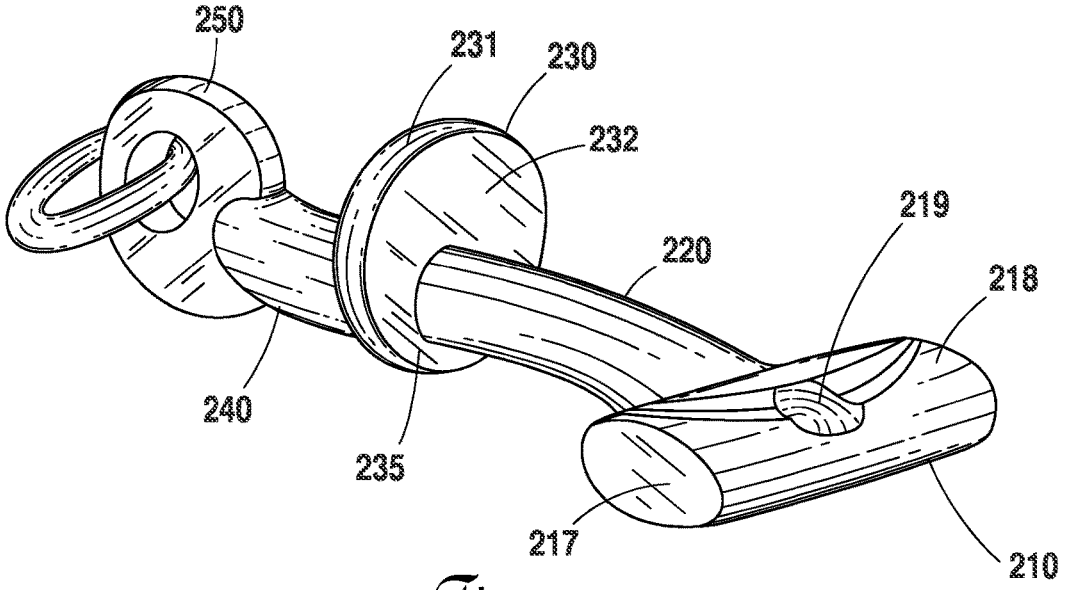
FIG. 10 is a perspective view of an embodiment of the transverse coupler portion of the present invention.
Figure 11:
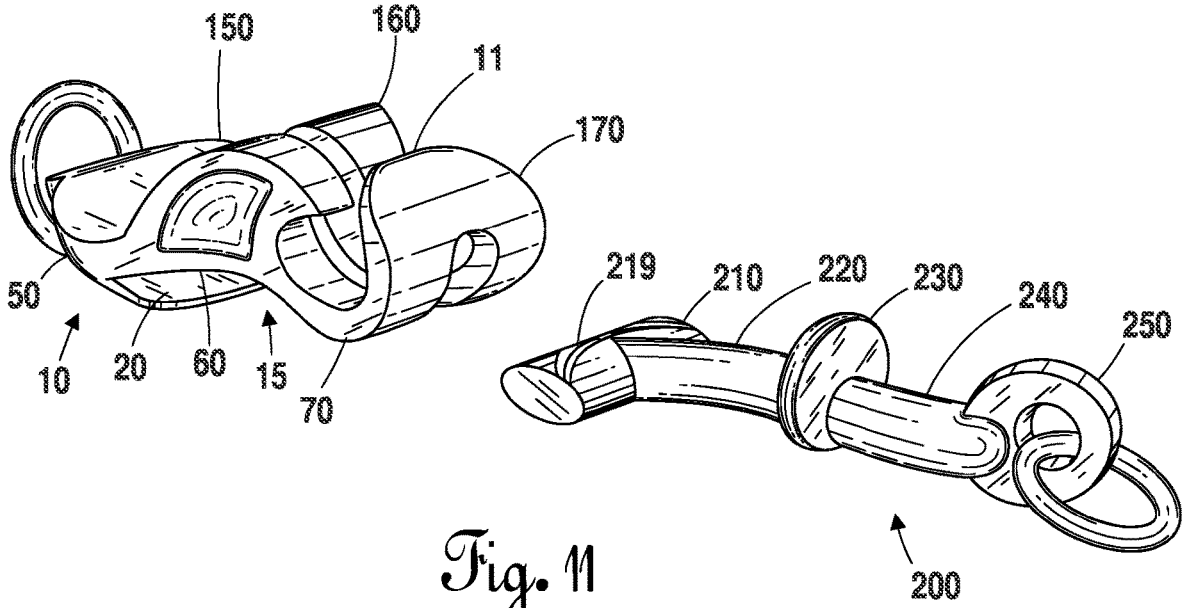
FIG. 11 is a perspective view of an embodiment of the cradle and transverse coupler portion of the present invention arranged in the first position of coupling.
Figure 12:
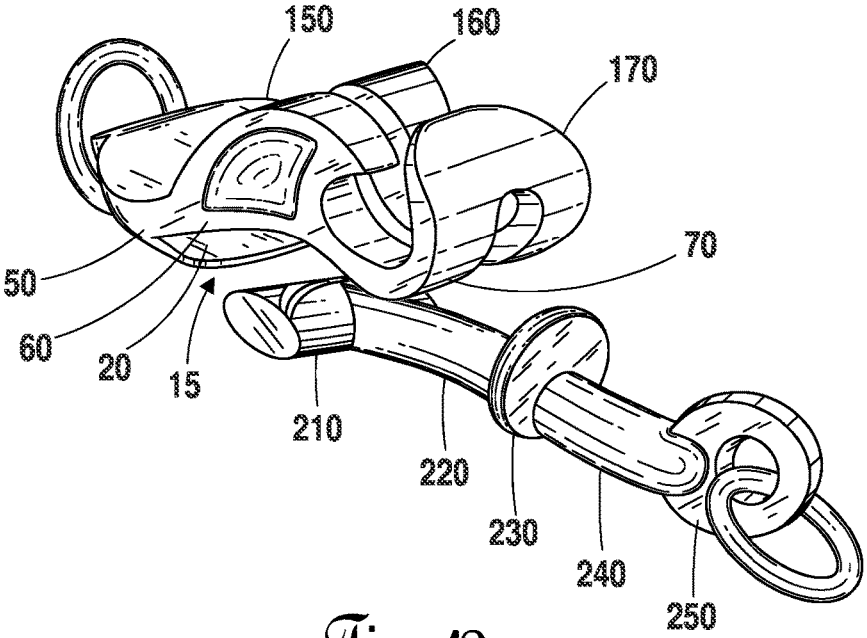
FIG. 12 is a perspective view of an embodiment of the cradle and transverse coupler portion of the present invention arranged in the second position of coupling.
Figure 13:
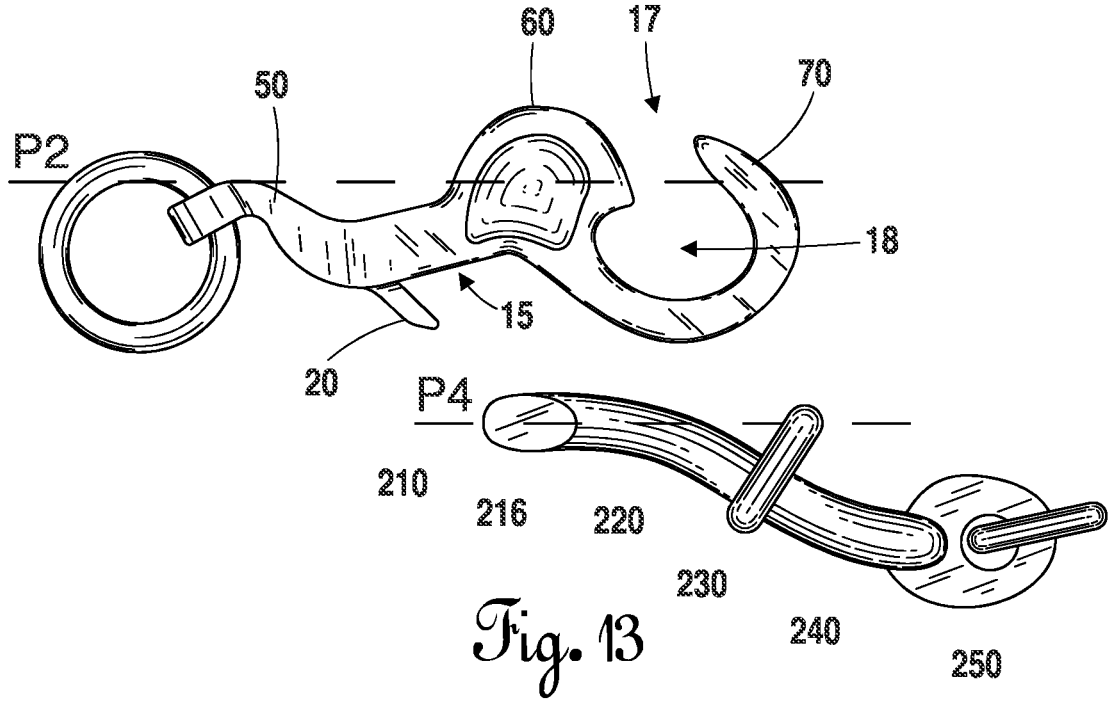
FIG. 13 is a side view of an embodiment of the cradle and transverse coupler portion of the present invention arranged in the second position of coupling.
Figure 14:
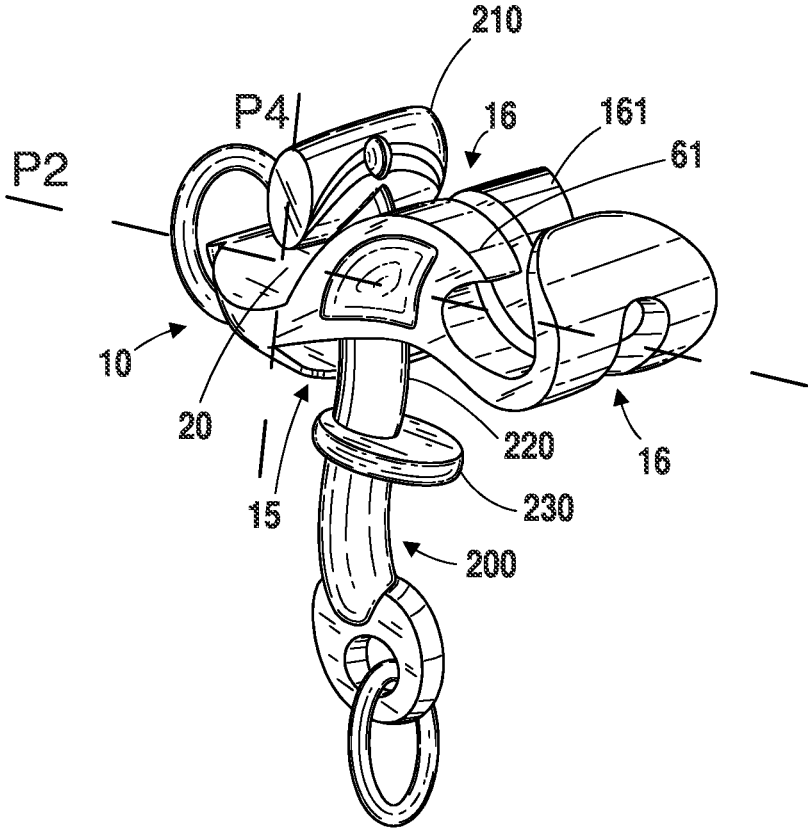
FIG. 14 is a perspective view of an embodiment of the cradle and transverse coupler portion of the present invention arranged in the third position of coupling.
Figure 15:
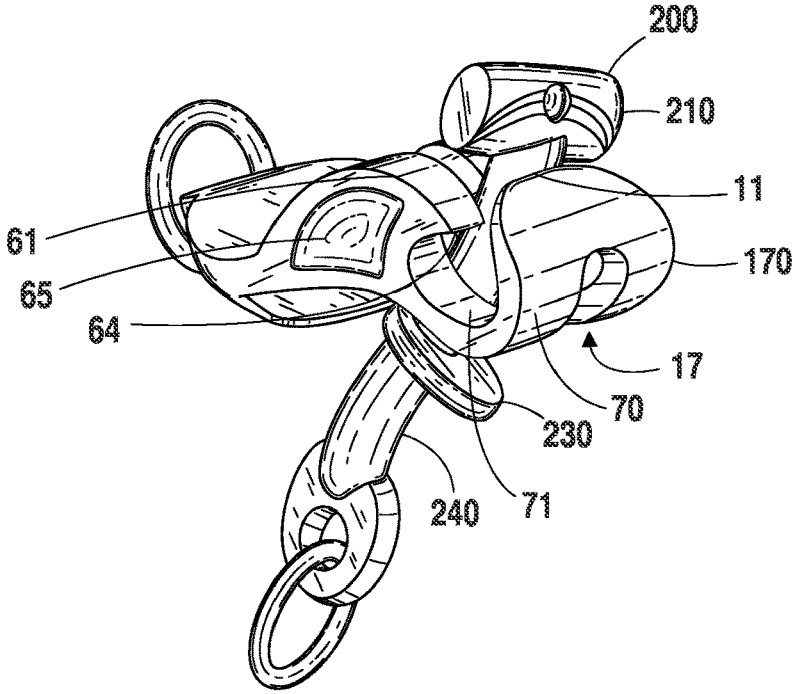
FIG. 15 is a perspective view of an embodiment of the cradle and transverse coupler portion of the present invention arranged in the fourth position of coupling.
Figure 16:
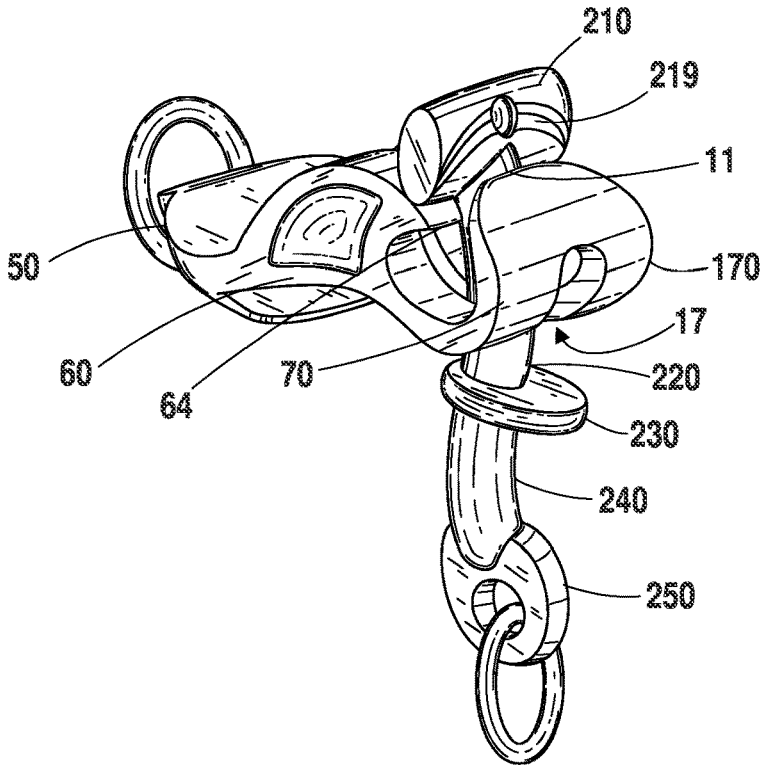
FIG. 16 is a perspective view of an embodiment of the cradle and transverse coupler portion of the present invention arranged in the fifth position of coupling.
Figure 17:
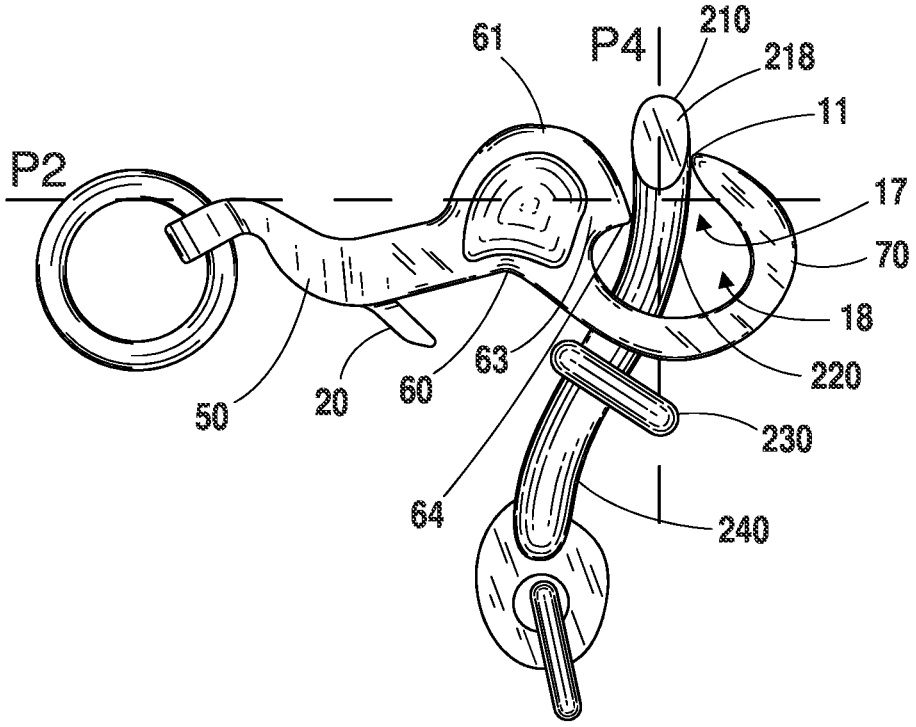
FIG. 17 is a side view of an embodiment of the cradle and transverse coupler portion of the present invention arranged in the fifth position of coupling.
Figure 18:
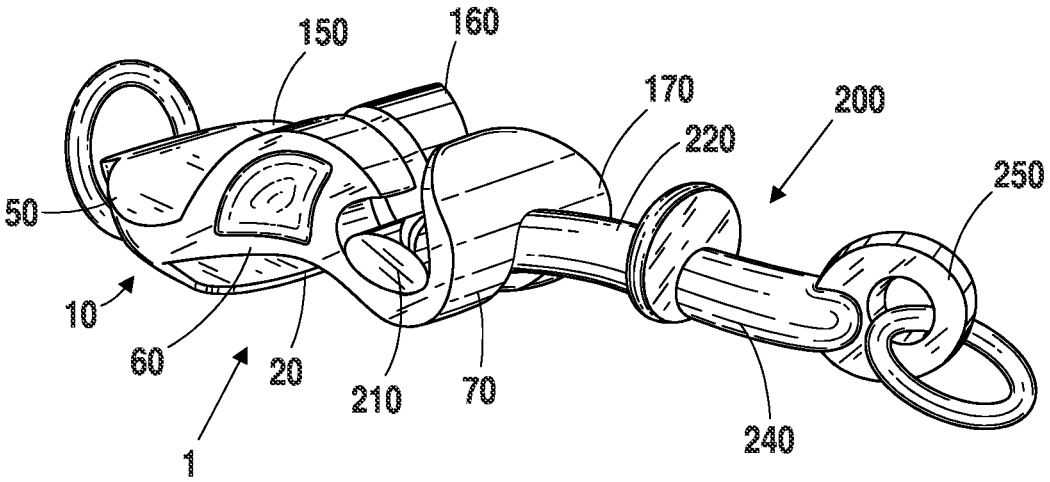
FIG. 18 is a perspective view of an embodiment of the cradle and transverse coupler portion of the present invention in the coupled position.

As seen in FIGS. 1-6, the female coupler 10 comprises an angled rear wall 20, a first arm 40, and a second arm 140. The first arm 40 connects to the second arm at a terminal front merge point 11, a rear merge point 12, and terminal rear merge point 13. A portion of the first arm 40, a portion of the second arm 140, and the angled rear wall 20 define a first channel 15 that is parallel to the angled rear wall 20. A second portion of the first arm 40 and a second portion of the second arm 140 define a second channel 16 that is perpendicular to the first channel 15. A plane P1 is parallel to the X axis and Y axis and perpendicular to the Z axis. Plane P1 extends through the center of, and runs parallel to, the second channel 16.

The first arm 40 and the second arm 140 are identical mirror images across plane P1 and comprise a top sidewall 41, 141, outer sidewall 42, 142, bottom sidewall 43, 143, and inner sidewall 44, 144 respectively. The first arm 40 and second arm 140 are generally parallel to plane P1 with each arm further comprising of a shoot portion 50, 150, a ridge portion 60, 160, and a scoop portion 70, 170. The inner wall 44 opposes the inner wall 144 across plane P1. A plane P2 is parallel to the X axis and Z axis, perpendicular to the Y axis, and extends from the apex 14 of the shoot portion 50, 150 and through the center of the ridge portion 60, 160.

The shoot portion 50, 150 comprises a connecting chain portion 51, 151, a jutting leg 52, 152, and a parallel leg 53, 153. The jutting leg 52, 152 extends from the rear merge point 12 laterally away from plane P1 and downward from plane P2. The parallel leg 53, 153 extends from the end of the jutting let 52, 152 and is parallel to plane P1 and plane P2. The connecting chain portions 51, 151 extend from each jutting leg 52, 152 and form a semicircle terminating at the terminal rear merge point 13. The connecting chain portions 51, 151 extend downward from plane P2. The apex 14 is formed at the juncture of the connecting chain portions 51, 151 and the jutting legs 52, 152. A hole is formed by the jutting legs 52, 152 and the connecting chain portions 51, 151. Rings, chains, ropes, or other lengthening devices may be connected to the hole between the terminal rear merge point 13 and the chain connecting portions 51, 151.

The angled rear wall 20 extends from and between the jutting legs 52, 152 generally at an angle similar to the jutting legs 52, 152 downward angle from plane P2. The angled rear wall 20, having a front surface 21 and a back surface 22, extends between and below each jutting leg 52, 152 and each parallel leg 53, 153. The front face 21 faces towards the ridge portions 60, 160. The front surface 21 of the angled rear wall 20 and the inner sidewall 44 and top sidewall 41 of the jutting legs 52, 152 are aligned to form a singular smooth surface. The angled rear wall 20 is thinner than the jutting legs 52, 152 resulting in a rear shoulder.

The ridge portions 60, 160 are generally cylindrical in shape with generally rounded sidewalls 61, 161, smooth flat ends 62, 162 and tapered ends 63, 163 opposing the smooth flat ends 62, 162. The smooth flat ends 62, 162 face each other and plane P1. The ridge portions 60, 160 extend from each of the parallel legs 53, 153 towards plane P1 and up through plane P2. The ridge portions 60, 160, and specifically the rounded sidewalls 61, 161, further comprise a catch 64, 164 that extends from the rounded sidewalls 61, 161 toward the terminal front merge point 11. The longest portion of the rounded sidewalls 61, 161 is adjacent to the parallel legs 53, 153 where the tapered ends 63, 163 narrow towards plane P1. The tapered ends 63, 163 and have indentions 65, 165. The first channel 15 is defined by the angled rear wall 20, the jutting legs 52, 152, the parallel legs 53, 153 and the rounded sidewalls 61, 161 of the ridge portions 60, 160. In the preferred embodiment, the width, as measured between the inner sidewalls 44, 144 of the parallel legs 53, 153, is longer than the length of the first channel 15 as defined by the distance between the rear angled wall 20 and the rounded sidewalls 61, 161 of the ridge portions 60, 160.

The scoop portions 70, 170 comprise an inner sidewall 71, 171, a top sidewall 72, 172, a bottom sidewall 73, 173, and an outer sidewall 74, 174. The scoop portion 70, 170 extends from under the catch 64, 164 of the ridge portion 60, 160, down from plane P2, and curves up towards and through plane P2, and ultimately back towards the ridge portions 60, 160 forming a scoop. The scoop portions 70, 170 of the arms 40, 140 connect at the terminal front merge point 11. The inner sidewalls 71, 171 are uniform with the smooth flat ends 62, 162 and parallel to plane P1. The second channel 16 is connected to the first channel 15 and shaped by the flat ends 62, 162 of the ridge portions 60, 160, the inner sidewalls 71, 171 of the scoop portions 70, 170, and the terminal front merge point 11. A scoop opening 17 is formed between the front merge point 11 and the catches 64, 164 of the ridge portions 60, 160. The scoop opening 17 leads into the male coupler receiver 18. The male coupler receiver 18 is a space shaped to receive the stop 210 of the male coupler 200. The male coupler receiver 18 is defined by the catches 64, 164, the top sidewalls 72, 172, and terminal front merge point 11 which combine to form an elliptical cylindrical space. In the preferred embodiment, the width of the second channel 16, as measured between the smooth flat ends 62, 162 and between the inner sidewalls 71, 171, is uniform.

In the preferred embodiment, the female coupler 10 is integrally manufactured with the angled rear wall 20, first arm 40, and second arm 140 are solid, integral, and constructed of a metal.

As seen in FIGS. 7-10, the male coupler 200 comprises a stop 210, a first shaft 220, a buffer 230, a second shaft 240, and a ring connection point 250. The stop 210 is a solid elliptical cylinder having a major axis 211, a minor axis 212, and a width 213. The stop 210 is proportioned to fit within the first channel 15 of the female coupler 10 such that the width 213 is slightly smaller than width of the first channel 15 and the minor axis 212 is smaller than the length of the first channel 15. The stop 210 comprises a sidewall 214, having a surface 215, a first face 216, and a second face 217. The major axis 211 corresponds to the X axis, the minor axis 212 corresponds to the Y axis, and the width 213 corresponds to the Z axis. A portion 218 of the surface 215 comprises a marker 219. In the preferred embodiment, marker 219 is an indentation that can be felt through touch. A plane P3 is parallel to the X axis, Y axis, and the major axis 211. Plane P3 is perpendicular to the z axis. Plane P4 extends through the midpoint of the stop 210 along the major axis 211 and is parallel to the X axis and Z axis. Plane P4 is perpendicular to the Y axis.

A first shaft 220, having a generally elliptical cylindrical shape, extends from the sidewall 214 at the midpoint of the width 213 of the stop 210. The major axis is parallel to plane P3 whereas the minor axis is perpendicular to plane P3. At the juncture of the first shaft 220 and the stop 210, the major axis of the first shaft 220 is parallel to plane P3 and the minor axis of the shaft 220 is parallel to plane P4. The first shaft 220 extends parallel to plane P4 before extending at a slight downward angle from plane P4. In one embodiment, the downward angle is approximately 20 degrees from plane P4. The marker 219 and portion 218 as discussed supra, are on the opposite sides of plane P3 as compared to the downward angle of the first shaft 220. The length of the minor axis of the first shaft 220 is smaller than the width of the second channel 15. The length of the first shaft 220 is greater than the height of the ridge portions 60, 160.

The first shaft 220 terminates at a buffer 230. The buffer 230 is a disc having a sidewall 231, a front face 232, and back face 233. The buffer is angled relative to the Y axis with the top portion 234 angled away from the stop 210 and the bottom portion 235 closer to the stop 210. The first shaft 220 terminates towards the bottom portion 235 of the buffer 230 as opposed to the center of the buffer 230. The diameter of the buffer 230 is greater than the width of the second channel 15.

A second shaft 240, having a generally cylindrical shape, extends from the back face 233 of the buffer 230. The second shaft 240 is generally aligned with the first shaft 220 as it relates to where the first shaft 220 terminates on the buffer 230. The second shaft 240 extends from the buffer 230 at approximately the same downward angle from the X axis as the first shaft 220 as it relates to where the first shaft 220 terminates on the buffer 230. The second shaft 240 then extends at an upward angle towards the X axis where it terminates into a ring connection point 250. As stated supra, the first shaft 220 has angle of approximately 20 degrees from plane P4 but other angles may be accommodated. The second shaft 240 has a similar angle of return before connecting to the to the ring connection point 250. The combination of the first shaft 220 and the second shaft 240 form a narrow "S". Rings, chains, ropes, or other lengthening devices may be connected to the ring connection point 250.

In the preferred embodiment, the male coupler 200 is integrally manufactured with the stop 210, first shaft 220, buffer 230, second shaft 240 and ring connection point 250 are solid, integral, and constructed of a metal.

Figure 19:
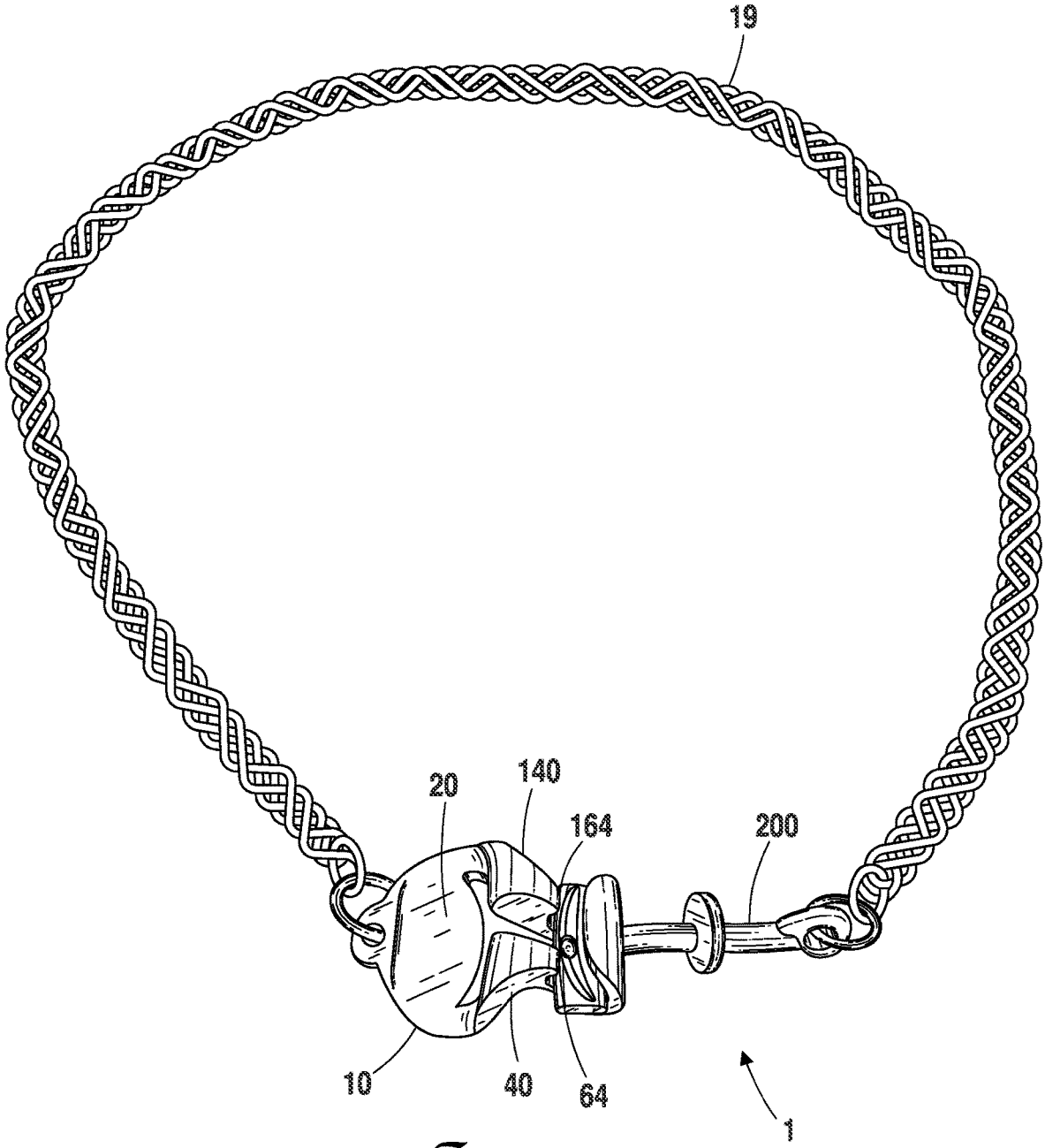
FIG. 19 is a perspective view of an embodiment of the cradle and transverse coupler of the present invention in coupled as part of a necklace.

The method of coupling the male coupler 200 to the female coupler 10 is described in relation to FIGS. 11-19. As seen in FIG. 19, a chain 19 is connected at one end to the female coupler 10 and to the male coupler 200 on the other end. The user grips the second shaft 240 of the male coupler 200 with one hand and either the shoot portions 50, 150 or the ridge portions 60, 160 of the female coupler 10 with the other hand. The male coupler 200 is positioned under the female coupler 10 and generally parallel to plane P2. The stop 210, and specifically the marker 219, is positioned adjacent and under the first channel 15. The marker 219 permits the user to orient the male coupler 200 by tactile sensation. The male coupler 200 is rotated such that the plane P4 is generally parallel to plane P2. The stop 210 is pushed into the shoot portion 50, 150 and against the front surface 21 of the angled wall 20 where it enters and passes through the first channel 15. The ring connection point 250 of the male coupler 200 is rotated away from plane P2 as the male coupler 200 is pushed through the first channel 15. The buffer 230 cannot enter the first channel 15 and prevents the male coupler 200 from extending too far through the first channel 15. Once positioned within the first channel 15 and extended through, plane P4 of the male coupler 200 is generally perpendicular to plane P2 of the female coupler 10.

The male coupler 10 is then slid towards the scoop portions 70, 170 within the second channel 16. The stop 210 slides over the ridge portions 60, 160 where it slides across the rounded sidewalls 61, 161 and onto the inner sidewalls 71, 171 of the scoop portions 70, 171 and the male coupler receiver 18. The buffer 230 prevents the male coupler 200 from extending too far through the second channel 16. The male coupler 10 is then rotated within the second channel 16 with the ring connection point 250 rotating towards plane P2 and simultaneously pulled down through the second channel 16 into the male coupler receiver 18 until the stop 210 rests against the top sidewalls 71, 171 of the scoop portions 70, 170. The stop 210 fits rests with the scoop portions 70, 170 such that the male coupler 10 is generally parallel with the female coupler 10. The stop 210 may rotate towards or away from plane P2 within the scoop portions 70, 170. The catches 64, 164 help prevent accidental release of the stop 210 from within the scoop portions 70, 170. The "S" curvature of the first shaft 220 and second shaft 240 allow the joined slip clasp 1 to conform to the curvature of a user's wrist, ankle, or neck. The "S" curvature further helps prevent accidental release of the male coupler-200 as the curvature helps direct any movement of the stop 210 into the catches 64, 164 as opposed to out of the scoop opening 17.

To remove the male coupler 200 from the female coupler 10, the second shaft 240 is rotated away from plane P2 until the stop 210 may be pushed through the second channel 16 away from the catches 64, 164. The male coupler 200 is then pushed through the second channel 16 over the ridge portions 60, 160 toward the first channel 15. Once though the second channel 16, the male coupler 200 may be pulled through the first channel 15 with the rounded sidewalls 61, 161 and the angled rear wall 20 providing smooth surfaces to allow for easy release of the stop 210.

The description of the present invention has been presented for purposes of illustration and description and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated. It will be understood by one of ordinary skill in the art that numerous variations will be possible to the disclosed embodiments without going outside the scope of the invention as disclosed in the claims.

I claim:

1. A slip clasp comprising:

a female coupler having a longitudinal axis, a shoot portion defining a first channel having a width and a length wherein the length is shorter than the width and further wherein the width is generally perpendicular to the longitudinal axis of the female coupler, a scoop portion defining a receiver, and a ring connection portion adjacent the shoot portion and opposite the scoop portion;

a male coupler having a longitudinal axis, a shaft with a stop connected on a first end and a ring connection portion connected on a second end opposing the first end, wherein the stop is shaped to fit through the first channel and shaped to fit within the receiver; and wherein the receiver has an opening having a length and further wherein the stop is an elliptical cylindrical shape having a width shorter than the width of the first channel but wider than the length of the first channel;

a major axis that is longer than the length of the opening of the receiver and generally parallel to the longitudinal axis of the male coupler; and a minor axis shorter than the length of the first channel and the length of the of the opening of the receiver and perpendicular to the longitudinal axis of the male coupler where the shaft connects to the stop.

2. The slip clasp of claim 1 wherein the shaft of the male coupler further comprises a buffer having a diameter larger than the shaft.

3. The slip clasp of claim 2 wherein the shaft of the male coupler between the stop and the buffer is an elliptical cylindrical shape having a major axis and a minor axis wherein the major axis is parallel to the minor axis of the stop where the shaft connects to the stop.

4. The slip clasp of claim 3 wherein the female coupler further comprises a ridge portion positioned between the shoot portion and scoop portion; and a second channel, having a width, defined by the ridge portion and scoop portion wherein the second channel is parallel to the longitudinal axis of the female coupler and extends perpendicularly from the first channel into the scoop portion.

5. The slip clasp of claim 4 wherein a catch is positioned on a portion of the ridge portion facing the scoop portion.

6. The slip clasp of claim 5 wherein the ridge portion and scoop portion further comprise a first side arm and a second side arm wherein the first side arm and second side are mirror images across the center plane.

7. The slip clasp of claim 6 wherein the first side arm of the shoot portion and the first side arm of the ridge portion and scoop portion are integral and wherein the second side arm of the shoot portion and the second side arm of the ridge portion and scoop portion are integral.

8. The slip clasp of claim 2 wherein the shaft is "S" shaped.

9. The slip clasp of claim 8 wherein the width of the second channel is wider than the minor axis of the shaft, narrower than the diameter of the buffer, and narrower than the width of the stop.

10. The slip clasp of claim 9 wherein the shoot portion further comprises a first side arm, a second side arm, and an angled wall disposed between the first side arm and second side arm wherein the first side arm and second side are mirror images across a center plane.

11. A slip clasp comprising:

a female coupler comprising a first channel having a width and a length, a second channel having a width, and a receiver; and a male coupler comprising a shaft with a first end and a second end sized to fit through the second channel;

an elliptical cylindrical stop, having a width shorter than the width of the first channel, longer than the width of the second channel, and longer than the length of the first channel;

a major axis; and a minor axis shorter than the length of the first channel connected to the first end of the shaft; and a buffer positioned on the shaft sized to prevent the shaft from passing through the first channel and second channel.

12. The slip clasp of claim 11 wherein the major axis is generally parallel to the shaft where the shaft connects to the stop.

13. The slip clasp of claim 12 wherein the shaft of the male coupler between the stop and the buffer is an elliptical cylindrical shape having a major axis wider than the width of the second channel and a minor axis narrower than the width of the second channel wherein the major axis is parallel to the minor axis of the stop where the shaft connects to the stop.

14. The slip clasp of claim 13 wherein the shaft is "S" shaped.

15. A slip clasp comprising:

a female coupler having a center plane comprising a first side arm having a first ring connection portion, a first shoot portion, a first ridge portion, and a first scoop portion having a terminal end;

a second side arm having a second ring connection portion, a second shoot portion, a second ridge portion, and a second scoop portion having a terminal end wherein the second side arm is a mirror image of the first side arm across the center plane and the first side arm is connected to the second side arm at the first ring connection portion and second ring connection portion and at the terminal end of the first scoop portion and second scoop portion;

an angled wall positioned between the first side arm and a second side arm within the shoot portion;

a first channel defined by the angled wall, the first shoot portion, the second shoot portion, the first ridge portion, and the second ridge portion;

a second channel defined by the first ridge portion, the second ridge portion, the first scoop portion, the second scoop portion, and the terminal end of the first scoop portion and second scoop portion wherein the second channel is parallel to the center plane and connected to the first channel;

a receiver formed by the first ridge portion, the second ridge portion, the first scoop portion, and the second portion;

a male coupler comprising a shaft with a stop connected on a first end and a ring connection portion connected on a second end opposing the first end, wherein the stop is shaped to fit through the first channel and shaped to fit within the receiver.

16. The slip clasp of claim 15 wherein a first catch is positioned on a portion of the first ridge portion facing the first scoop portion and a second catch is positioned on a portion of the second ridge portion facing the second scoop portion.

* * * * *